US005416466A

United States Patent [19]

Malvaso et al.

[11] Patent Number: 5,416,466

[45] Date of Patent: May 16, 1995

[54] PERSONAL SECURITY SYSTEM WITH FIXED TESTING TRANSMITTERS

[75] Inventors: John A. Malvaso, Victor; Pasquale L. Amodio, Fairport, both of N.Y.

[73] Assignee: Detection Systems, Inc., Fairport, N.Y.

[21] Appl. No.: 198,716

[22] Filed: Feb. 18, 1994

[51] Int. Cl.[6] ..... G08B 1/08

[52] U.S. Cl. ..... 340/539; 340/514; 340/531; 455/49.1

[58] Field of Search ..... 340/539, 531, 514, 825.06, 340/825.69, 825.72; 455/67.1, 68, 70, 38.1, 38.2, 92, 95, 100, 54.2, 49.1; 341/173, 174, 176

[56] References Cited

U.S. PATENT DOCUMENTS

| | | | |
|---|---|---|---|
| 4,367,458 | 1/1983 | Hackett | 340/539 |
| 4,523,184 | 6/1985 | Abel | 340/539 |
| 4,611,198 | 9/1986 | Levinson et al. | 340/539 |
| 4,622,538 | 11/1986 | Whynacht et al. | 340/539 |
| 4,630,035 | 12/1986 | Stahl et al. | 340/539 |
| 4,694,282 | 9/1987 | Tamura et al. | 340/539 |
| 4,764,757 | 8/1988 | DeMarco et al. | 340/574 |
| 4,884,060 | 11/1989 | Shapiro | 340/514 |
| 4,908,602 | 3/1990 | Reich et al. | 340/514 |
| 4,998,095 | 3/1991 | Shields | 340/574 |
| 5,115,223 | 5/1992 | Moody | 340/539 |
| 5,223,816 | 6/1993 | Levinson et al. | 340/539 |

*Primary Examiner*—Donnie L. Crosland
*Attorney, Agent, or Firm*—J. Addison Mathews

[57] ABSTRACT

A personal security system includes signaling transmitters and receivers for detecting the transmitted signals. The receivers provide an output representing the received signal strength, which is used in combination with the position of the receiver for locating the point of transmission. All of the transmitters are substantially identical, at least in their transmission characteristics and transmitted signal strength, but include a first portable set of transmitters intended to be carried by subscribers, and a second fixed set of transmitters associated with the receivers. The fixed transmitters are actuated one after another and the receivers are polled to record received signal strength after each transmission from each receiver. The results permit comparisons with expected values, between receivers and over time.

8 Claims, 6 Drawing Sheets

| RECEIVERS | A | B | C | D | E | F | G | H |
|---|---|---|---|---|---|---|---|---|
| 1 | | | | | | | | |
| 2 | | | | | | | | |
| 3 | | | | 14 | | | | |
| 4 | | | 13 | 15 | 11 | | | |
| 5 | | | | 12 | 9 | | | |
| 6 | | | | | 8 | | | |
| 7 | | | | | | | | |
| 8 | | | | | | | | |

RECEIVERS

FIG. 7

| RECEIVERS | A | B | C | D | E | F | G | H |
|---|---|---|---|---|---|---|---|---|
| 1 | | | | | | | | |
| 2 | | | | | | | | |
| 3 | | | | | | 12 | | |
| 4 | | | | | 9 | 10 | 9 | |
| 5 | | | | | 6 | 8 | | |
| 6 | | | | | | | | |
| 7 | | | | | | | | |
| 8 | | | | | | | | |

RECEIVERS

FIG. 8

PERSONAL SECURITY SYSTEM WITH FIXED TESTING TRANSMITTERS

CROSS-REFERENCE TO RELATED APPLICATIONS

Reference is made to commonly-assigned, copending, U.S. patent application Ser. No. 08/126,841, entitled PERSONAL SECURITY SYSTEM WITH TRANSMITTER TEST MODE, filed Sep. 20, 1993 in the name of D. Pedtke, the disclosure of which hereby is incorporated by reference into the present specification.

BACKGROUND OF THE INVENTION

1. Field of Invention

The invention relates to personal security systems including routines for locating emergency transmissions, and to the selective testing of such systems for proper operation. More specifically, the invention relates to security systems including a network of communications devices, and to apparatus for testing the devices and communications between the devices.

2. Description of the Prior Art

Personal security devices come in many varieties, ranging from noisemakers that scare, to irritant sprays that deter and signal transmitters that call for help.

A number of recently proposed and more sophisticated systems include portable radio frequency transmitters carried by a system subscriber for actuation in emergency or threatening situations. Fixed receivers monitor the area where the system is installed and initiate a planned sequence of events when an emergency transmission is detected. Sirens and strobes may be energized to scare away attackers while a call is made for assistance from appropriate security personnel. The system usually is monitored from a control station including a program for identifying the approximate location of the threatened subscriber using the known positions of the receivers that detect the transmission. Examples of these and similar approaches are disclosed in Shields U.S. Pat. No. 4,998,095, issued Mar. 5, 1991; DeMarco U.S. Pat. No. 4,764,757, issued Aug. 16, 1988; and Levinson U.S. Pat. No. 4,611,198, issued Sep. 9, 1986. An improved approach for more precisely locating the transmission is disclosed in Kostusiak U.S. Pat. No. 5,115,224. In addition to the known positions of the monitoring receivers, he uses the relative strengths of the signals compared between several receivers.

Testing is an important feature in security systems, and many alternatives are available. Reich et al. U.S. Pat. No. 4,908,602, issued Mar. 13, 1990, discloses a personal emergency response system, somewhat similar to those mentioned above, including a momentary action button on a fixed receiver for selectively placing the system in a test mode. Testing of the communications link between the portable transmitter arid the receiver will not then initiate the alarm. Tamura et al. U. S. Pat. No. 4,694,282, issued Sep. 15, 1986, also discloses a test mode in a security system, this time actuated by a switch on affixed transmitter. Tamura et al. transmit test signals to a receiver at a level representing a worst case environment.

PROBLEM SOLVED BY THE INVENTION

Existing devices Lot testing personal security systems often test only the link between the portable transmitter and the first receiver. Although this link usually is the most fragile from a communications viewpoint, other links may tail unnoticed.

Tests initiated from the portable transmitter are important, but not sufficient. They represent actual conditions of operation, including antenna orientation, transmitter position, and many other variables. For this same reason, however, the portable transmitter is not a good initiator of calibration tests, which are particularly important in systems that compare received signal strengths.

Existing approaches for testing personal security systems are pass or fail. They don't record change in performance or show history or trends. Similarly, they don't provide a control for comparing results under different operating conditions.

SUMMARY OF THE INVENTION

The present invention is directed to overcoming one or more of the problems set forth above in a personal security system that includes transmitters of radio frequency signals and receivers that detect the signals and provide an output representing the received signal strength. Briefly summarized, according to one aspect of the invention, the transmitters are substantially similar, particularly in their transmission characteristics and transmitted signal strength, but include a first portable set of transmitters intended to be carried by subscribers, and a second set of transmitters fixed relative to the receivers.

In more specific embodiments of the abovementioned feature, the transmitter signal includes first and second codes. The first code identifies the transmitter, while the second code, called a class code, is selectable to identify the transmitted signal by type, as an alarm or a test, and the transmitter by assignment, to a subscriber or to security or maintenance personnel. In the fixed transmitters, the first code represents transmitter location and the second code identifies the mode of operation as a system test.

According to another feature of the invention, the fixed transmitters are actuated one after another and the receivers are polled after each transmission. The received signal strength is recorded after each transmission from each receiver and can be compared to the signal strength from other receivers, or to prior or expected values.

Still more specific features provide for comparing values in a first matrix of received signal strengths with values in a second matrix of received signal strengths. The first and second matrices represent signals received over two relatively short time periods spaced by a longer time period, supporting calibration and trend analysis.

ADVANTAGEOUS EFFECTS OF THE INVENTION

The invention provides for testing a personal security system with fixed transmitters that are substantially identical to the subscribers portable transmitters, at least in the characteristics and strength of the transmitted signal. The fixed transmitters have the same orientation and environment, so the transmitting parameters are repeatable for each test, facilitating system calibration in addition to pass or fail testing.

The fixed transmitters are selectively actuated and a representation of the received signal strength is established at each detecting receiver. Again this facilitates calibration. It also provides historical information for understanding the characteristics of the system and permits trend analysis for predicting changes over time. The effect of humidity, temperature, atmospheric disturbances and other weather parameters can be determined under controlled conditions. Degraded performance can be detected and failures predicted.

Testing can be controlled from a control station, permitting a sweep of the entire system from a single control position. With the exception of the subscriber's portable transmitter, which should be tested separately, a sweeping system test includes all of the system components and communications, without interrupting the period of protection or disturbing the individuals in the protected area.

These and other features and advantages of the invention will be more clearly understood and appreciated from a review of the following detailed description of the preferred embodiments and appended claims, and by reference to the accompanying drawings.

BRIEF DESCRIPTION OF THE DRAWINGS

FIG. 7 is a schematic representation of a first matrix including received signal strengths resulting from one transmitter test in accordance with the invention.

FIG. 8; is a schematic representation of a second matrix including received signal strengths resulting from another transmitter test in accordance with the invention.

DESCRIPTION OF THE PREFERRED EMBODIMENTS

Overview

Figure 1:
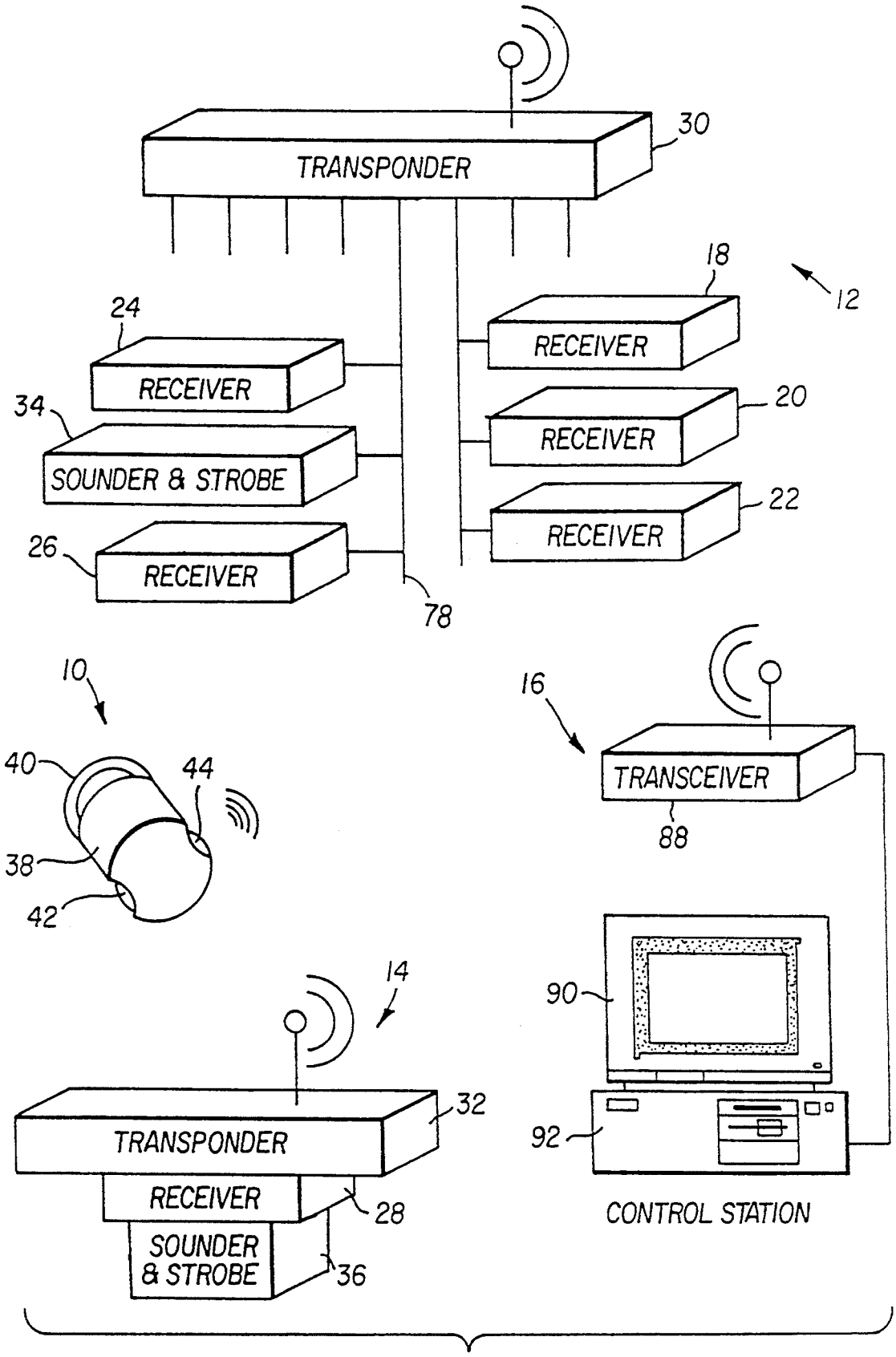
FIG. 1 is a schematic view of a personal security system including radio frequency transmitters, receivers and a control station, according to a preferred embodiment of the invention.

Referring now to FIG. 1, a preferred embodiment of the invention is depicted in a personal security system including hand-portable transmitters 10, different combinations 12 and 14 of fixed receivers and transponders, and a control station 16.

The transmitters 10 are carried by subscribers to the system for actuation in emergency or threatening situations to initiate planned events that scare away attackers and call for assistance. The transmitters send a radio frequency signal to the surrounding area, at a predetermined frequency and signal strength, including a unique code that identifies the transmitter.

Receivers 18, 20, 22, 24, 26 and 28 monitor the protected area for transmissions and, in combination with transponders 30 and 32 and control station 16, initiate the planned events. The receivers also detect information about the transmitted signal, including the strength of the received signal and the transmitter identification, and store the information for use by the control station to determine the location of the transmission and the name of the subscriber to which the transmitter is assigned. Sounders and strobes 34 and 36 are actuated in the vicinity of the transmission, and security personnel are dispatched to the same area for assistance.

The system includes several testing mechanisms. One is referred to as a subscriber test, and is initiated by a subscriber's actuation of the portable transmitter. Another, which is the subject of this invention, is referred to as a system test, and involves transmitters that are replicates of the portable transmitters, at least in transmitted signal characteristics, but are fixed relative to the receivers. System testing according to the present invention has particular utility when combined with subscriber transmitter testing.

Transmitter and Transmitted Signal

Portable Transmitters

The hand-portable transmitter 10, most clearly shown in FIGS. 1, 2, 3 and 5, is battery powered and adapted for convenient carrying in a purse or pocket. It is enclosed in a plastic case 38 .including a key ring 40 and two switches depicted as depressable buttons 42 and 44. The switches are designed for actuation from opposite sides of the case against a spring bias and in a sequence that normally prevents accidental operation.

The switches 42 and 44 initiate operation of the transmitter, either in an alarm state or a test state, depending on the sequence of actuation. In both cases, alarm or test, the transmitter produces and transmits a radio frequency signal to the local geographic area at a predetermined frequency and signal strength. The frequency may be in the three hundred or nine hundred megahertz range typical for such applications. The signal strength is chosen in combination with the number and locations of the fixed receivers 16 so more than one and preferably at least three receivers typically will be able to identify and interpret the transmitted signal for the purposes to be described. At the same time, the signal strength, which falls off with the inverse square of the distance, should be weak enough to facilitate the location of the transmission based on differences in the signal strength at the detecting receivers.

Figure 2:
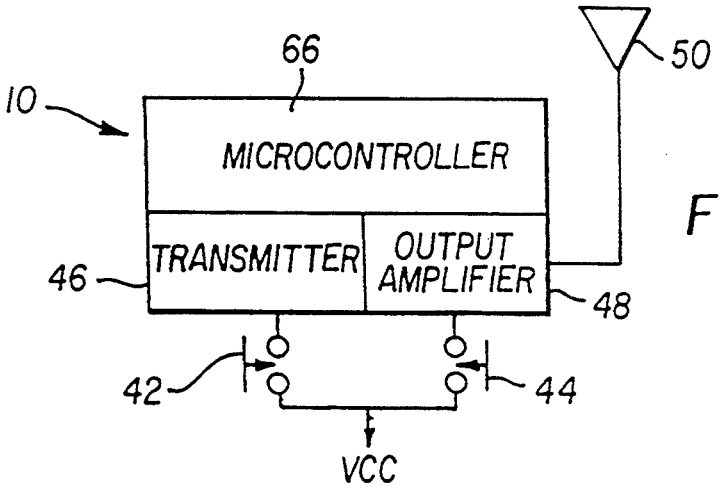
FIG. 2 is a schematic representation of a portable radio frequency transmitter for use with the preferred embodiment of FIG. 1.
Figure 3:
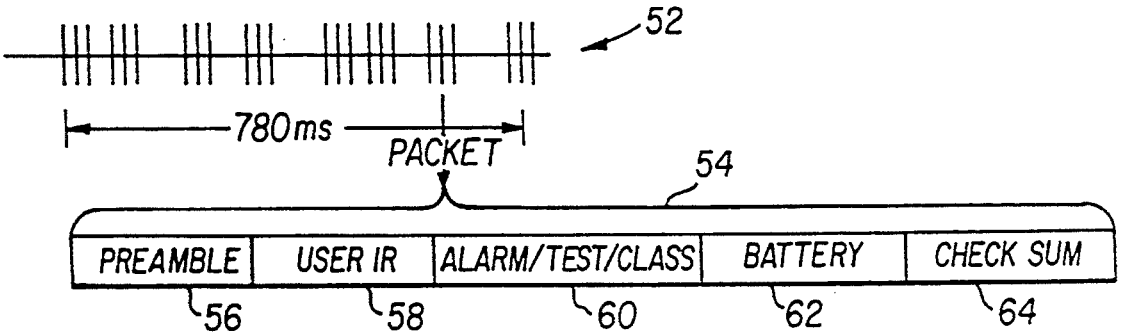
FIG. 3 is a schematic representation of the radio frequency signal from the transmitter of FIG. 2.

Referring now to FIGS. 2 and 3, actuation of the transmitter in either an alarm or a test mode broadcasts, or more accurately narrowcasts, a signal through transmitter 46, output amplifier 48 and antenna 50 to the local geographic area. The signal includes a series of eight identical packets of information 52, having an irregular spacing to reduce the risk of jamming with other possible transmissions. The packets each contain the information identified at 54, including a preamble 56, a user or transmitter identification (ID) code 58, an alarm or test and class code 60, a low-battery warning set bit 62, and a check sum 64 for error detection. The portable transmitter and its various functions operate under the control of a micro controller 66 which includes associated memory and appropriate timers (not separately shown).

The ID code is programmed and stored in memory, either at the time of manufacture or when the user subscribes to the system. The alarm or test and class code is set in part when the transmitter is manufactured, for either a subscriber, maintenance personnel or security personnel, and in part by the manner in which switches 42 and 44 are actuated. Simultaneous actuation of the switches 42 and 44 sets the code to indicate an alarm. Sequential actuation of the switches 42 and 44 sets the code to indicate a test. The code is three bits long, providing for eight possible settings, of which six are used. Settings pertinent to the present application include a subscriber alarm or test and a maintenance alarm or test, again depending on the assignment and switch actuation.

Testing with the transmitter involves the same mechanical and electrical components of the portable transmitter in both the test mode and the alarm mode, differing only in sequence of operation. The same actuating switches are used, the same batteries, the same microcontroller and the same transmitter and antenna.

Figure 5A:
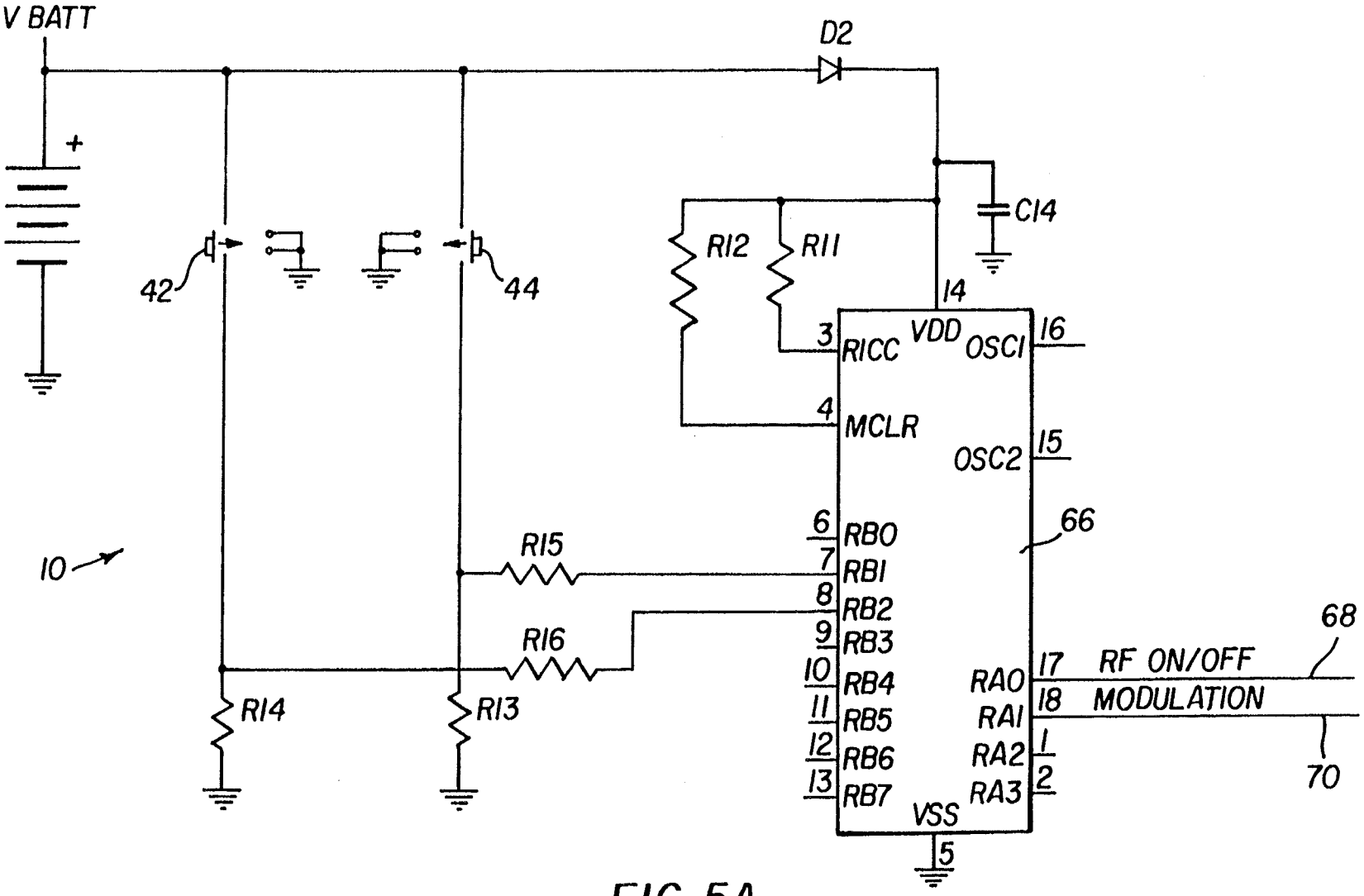
FIGS. 5A and 5B are schematic circuit diagrams of the transmitter of FIG. 2.
Figure 5B:
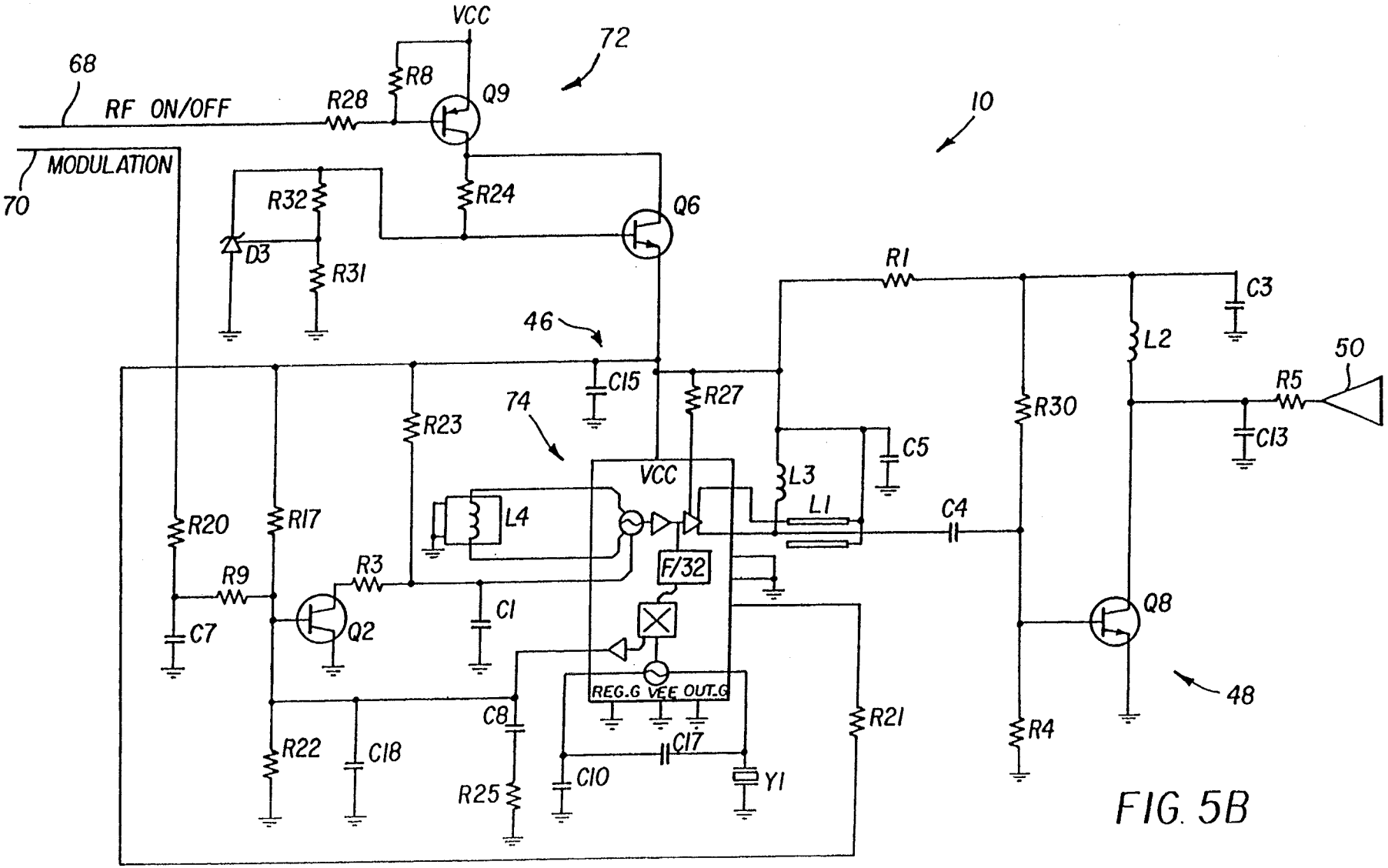
Figure 6:
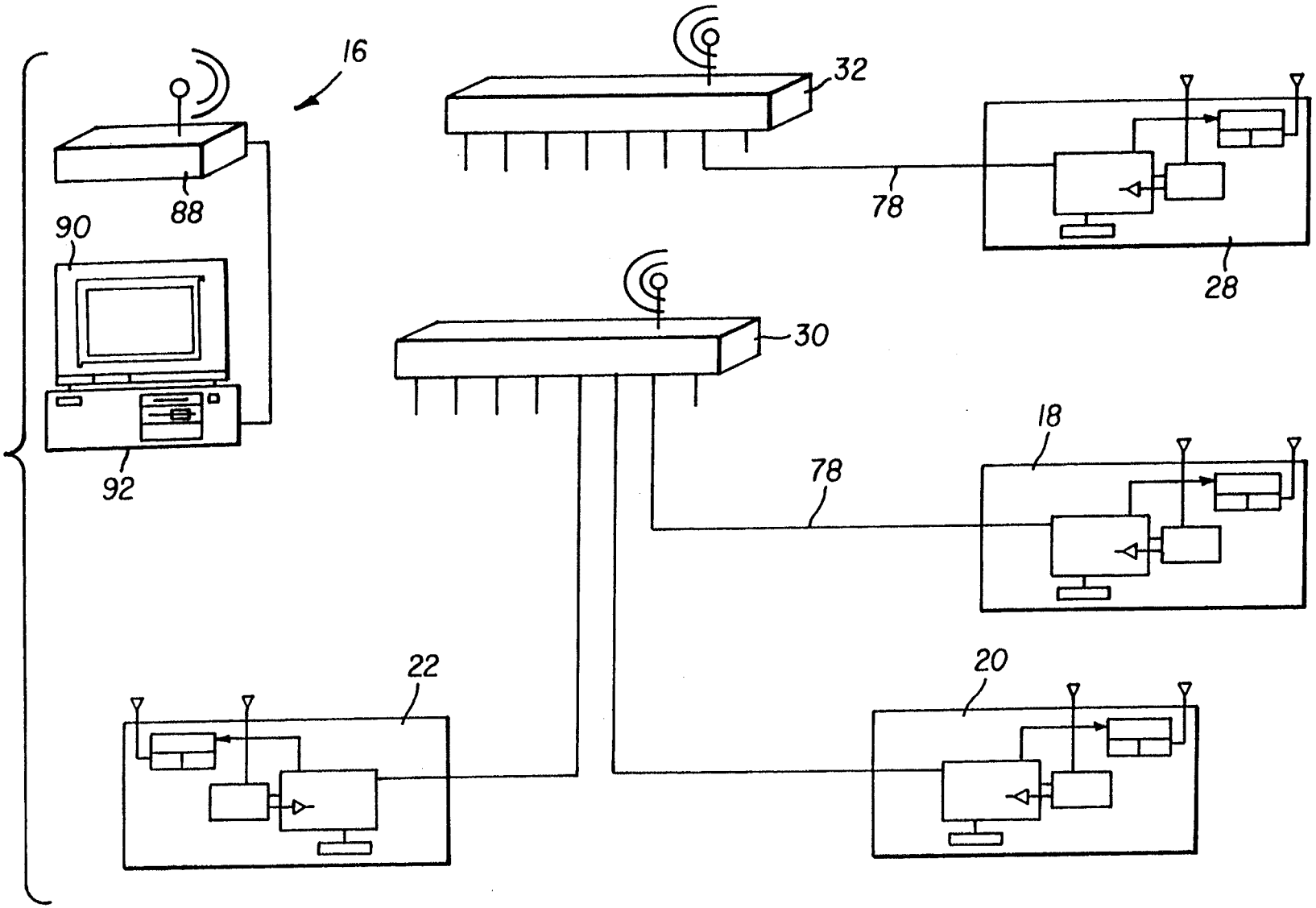
FIG. 6 is a schematic representation of a system according to the preferred embodiment depicting its operation in a test mode.

The transmitter circuit is illustrated in FIGS. 5A and 5B. FIG. 5A shows the switches 42 and 44 that operate in conjunction with timers and memory in the microcontroller 66. When an alarm or test is properly actuated, the microcontroller 66 sends first and second outputs 68 and 70 to transmitter 46 (FIG. 5B). Output 68 turns the transmitter on, while output 70 includes the information to be included in the transmitted signal, most notably the test or alarm and class code and the identification of the transmitter. FIG. 5B includes a voltage regulating circuit 72, the transmitter 46, including internal oscillator 74, amplifier 48 and antenna 50.

Fixed Transmitters

Figure 4:
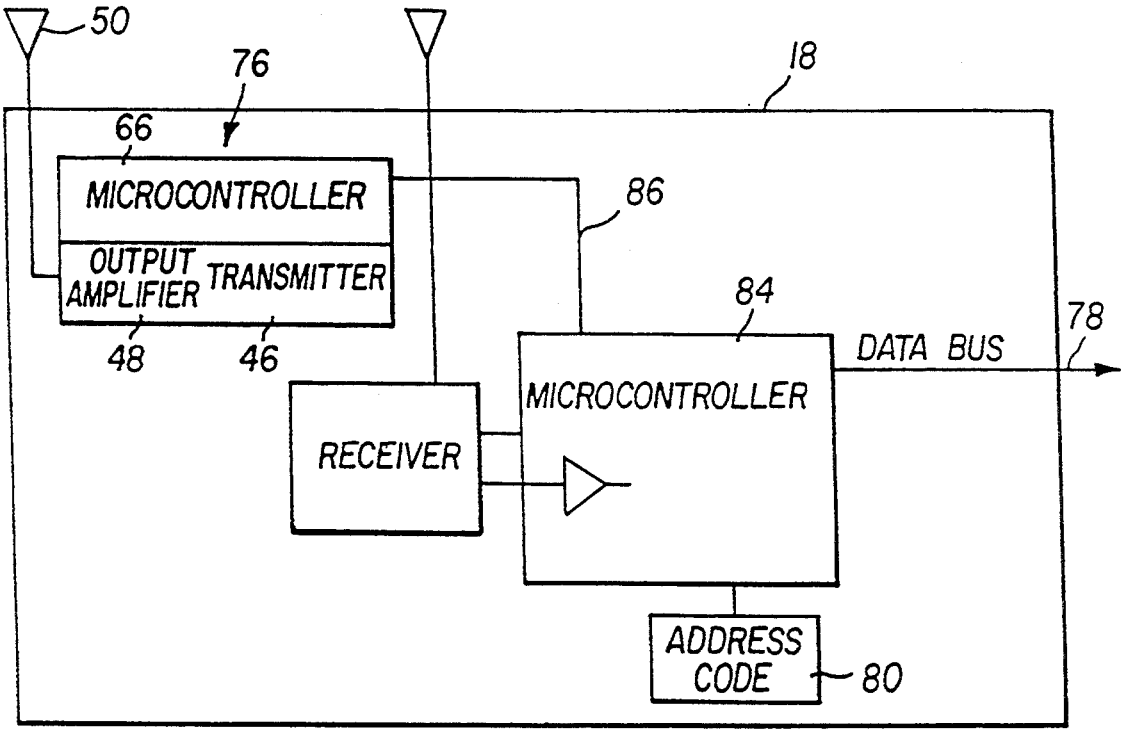
FIG. 4 is a schematic representation of a receiver including a built-in fixed transmitter substantially identical in transmitting characteristics to the transmitter of FIG. 2.

Transmitters according to the present invention are provided in two sets. A first or portable set 10, as described above, and a second set 76 (FIG. 4) that is fixed relative to the receivers. With the exception of portability, the power source and the mechanical parts of switches 42 and 44, the transmitters are identical, including the same transmitter 46, amplifier 48 microcontroller 66 and antenna 50. The same reference characters are used to identify these common components. Most notably, however, both sets of transmitters have the same transmission characteristics, such as frequency and signal strength.

The transmitter identification code of the fixed transmitters represents the location of the transmitter instead of the subscriber, and the class code is set always to indicate an alarm for maintenance purposes.

Receivers and Transponders

The fixed receivers in this preferred embodiment are coupled to transponders in two different combinations 12 and 14 (FIG. 1). The combination depicted at 14 is preferred for outdoor use and includes a receiver 28, transponder 32 and sounder 36. The receiver, transponder and sounder are collocated and coupled with appropriate logic in a single weatherproof container. The receiver is positioned for good radio reception from the surrounding area, and is provided with appropriate antennas for monitoring the transmitters 10 and 68, and for communicating with the control station 16.

The other combination 12 includes several receivers 18, 20, 22, 24, and 26, multiplexed to one transponder 30, again with appropriate logic and one or more sounders and strobes 34.

The receivers are tuned to continuously monitor the predetermined frequency used by the portable and fixed transmitters. They decode transmitter signals, validate the transmission for proper format, sample the strength of validated signals and set a normal/off-normal bit flag depending on the information received. A decoded transmission, assuming it is in the proper format, is stored in a data register, including the received signal strength, the identification number of the portable transmitter and the state of the normal/off-normal flag bit.

The receivers communicate with their associated transponder 30 through a bus 78. The transponder queries each receiver using a unique identification or address code 80 (FIG. 4) associated with each receiver. If the flag bit is normal, the transponder continues with queries cycled to other receivers. If the flag bit is oil-normal, indicating, for example, either an alarm or a test, the transponder requests the stored information. This includes the reason for the off-normal condition, e.g. alarm or test, the strength of the received signal and the unique identification code of the sending transmitter. The transponder also associates the retrieved transmitter and signal information with the identification code of the receiver that is holding the information.

Several receivers preferably will receive, store and transfer information connected with a single alarm or test. This information is handled slightly differently, depending on the class code identified with the transmitter. As mentioned above, the class code identifies the transmitter assignment to a subscriber or to maintenance personnel.

Subscriber Alarm or Test

If the alarm or test is initiated by a subscriber, as determined by the class code, the transponder compares the information, selects the three strongest signals, and sends the information, including received signal strength, transmitter identification, and receiver identification, on to the control station. The control station makes a similar comparison with information that might be received from other transponders and displays on a screen the location of the receivers of the three strongest signals.

If the off-normal condition is caused by a subscriber alarm, the transponder and control station will issue commands activating the sounder and strobe closest to the three above-mentioned receivers. If caused by a subscriber test, the control station will use the unique identification of the portable transmitter to look in its records for an active subscriber, and will indicate the results of the test by energizing a green or red light emitting diode (LED, not shown) on the three receivers. The red LED might be actuated, for example, to indicate an expired subscription, while the green LED would indicate a successful subscriber test.

System Test

A system test is initiated from the control station through the transponder and selected receivers. A microcontroller 84 (FIG. 4) in a selected receiver activates its associated fixed transmitter 76 through line 86, which replaces the mechanical components of switches 42 and 44.

The alarm or test and class code of the fixed transmitter 76 is always set for a maintenance alarm. When this code is detected by the receivers and transponders, they forward information from all of the received signals, not just the strongest three. Similar to the subscriber alarm or test, the forwarded information includes the received signal strength, and the identifies of the transmitter and receiver.

Control Station

Control station 20 (FIG. 1) includes a transceiver 88, monitor 90, computer 92. The control station communicates with the transponders 30 and 32 for controlling the sounders and strobes 34 and 36 in the alarm mode and the red and green LEDs in the test mode. The control station also is used for entering system information and parameters. It might include a map of the protected area and a program for showing the locations of receivers in the vicinity of an alarm or test transmission. Typically, the control station will store subscriber records including active or inactive status, identification of the portable transmitter assigned to each subscriber, and the times and locations from which it was used, either in an emergency or for a test.

The control station also initiates system tests according to the present invention, as described in the next section.

Operation for System Testing

Referring now to the operation of a system test, and to FIGS. 4 and 6–9, the control station initiates a test through the transponders and receivers, actuating one fixed transmitter at a time and collecting the resulting data. The fixed transmitter 76 in receiver 22 might be actuated first. Assuming the other receivers 18, 20 and 28 are within range, they will record the signal strengths received at their respective locations and send the information to control station 16. FIG. 7 is a matrix representing the results of such a first transmission for seven receivers. Each of the seven numbers in the matrix represent received signal strength for one receiver, respectively. A relatively short time later, the fixed transmitter 76 in receiver 28 might be actuated, and a similar matrix recorded, as represented in FIG. 8. This process is continued, sweeping through the protected area by actuating all of the fixed transmitters.

The collected information provides experience matrices that can be compared to each other and to expected results over relatively longer time periods compared to the time required to complete one sweep of the protected area. In addition to a pass or fail test of most system components, the information is particularly valuable for calibrating the system and showing trends that predict failures before they occur.

While the invention is described in connection with a preferred embodiment, other modifications and applications will occur to those skilled in the art. The claims should by interpreted to fairly cover all such modifications and applications that fall within the true spirit and scope of the invention.

What is claimed is:

1. A personal security system including a test feature using characteristics of radio frequency transmissions; comprising:

a plurality of transmitters, each of said transmitters respectively including means for transmitting a radio frequency signal having predetermined transmission characteristics which are the same for all of said transmitters, said signal including one code unique to the transmitter and another code identifying a transmission class;

a plurality of receivers, each of said receivers respectively including means for receiving the signals from said transmitters, said receivers providing an output representing the transmitter code, the transmission class, and the transmission characteristics, for each of said received signals;

said plurality of transmitters including a first portable set of transmitters that are hand-holdable, and a second set of transmitters fixed adjacent said receivers; and, a control station including means using said receiver output for locating said signal transmissions from said portable set and for displaying test information representing said signal characteristics of said signal transmissions from said fixed set.

2. The invention of claim 1, wherein said class code identifies the transmitted signal by type, as an alarm or a test signal, and the transmitter by assignment, as a subscriber or non-subscriber assigned transmitter.

3. The invention of claim 2, wherein said control station includes means for selectively initiating transmissions from the transmitters only in said second set one after another.

4. A personal security system for locating emergency radio frequency transmissions from a portable set of transmitters and including a test mode using radio frequency transmissions from a fixed set of transmitters; said system comprising:

a plurality of radio frequency transmitters, each of said transmitters being selectively actuatable to transmit signals at a predetermined radio frequency and transmitted signal strength, said signals from each respective transmitter including a code unique to the transmitter;

a plurality of fixed communication devices monitoring the frequency of said transmitter signals for receiving said transmitter signals, and including means for providing an output representing the identity of the communication device, the unique code of any transmitter from which the signals are received, and a received signal strength for the received signals;

said plurality of transmitters including said portable set and said fixed set; and, a control station for communicating with said communication devices to receive said output, said control station and said devices including means for selectively initiating transmission of said signals from said fixed transmitter set and for displaying test information representing the received signal strength of said selectively initiated transmissions.

5. The invention of claim 4, wherein said control station includes means for identifying differences over time in the received signal strength for signals with the same unique code.

6. The invention of claim 4, including means for providing a matrix of received signal strengths representing signals received from said plurality of fixed transmitters.

7. A personal security system; comprising:

a set of portable, hand-holdable transmitters, each of said portable transmitters being hand actuatable to transmit radio frequency signals at a first frequency and first transmitted signal strength;

a set of fixed transmitters, each said fixed transmitter being electronically actuatable to transmit radio frequency signals at a second frequency the same as the first frequency and a second transmitted signal strength not greater than the first transmitted signal strength;

a plurality of communication devices receiving said portable and fixed transmitter signals and including means for providing an output representing received signal strength; and, means communicating with said fixed transmitters for actuating said fixed transmitters selectively at different times and for comparing the strengths of the received signals.

8. The invention of claim 7, including means for comparing a first matrix of signal strengths with a second matrix of signal strengths, said first matrix representing signals received by said communication devices from said plurality of fixed transmitters over one relatively short period of time, said second matrix representing signals received by said same communication devices from said same fixed transmitters over another relatively short period of time substantially later than the first time period.

* * * * *